US006547416B2

(12) United States Patent
Pashley et al.

(10) Patent No.: US 6,547,416 B2
(45) **Date of Patent: *Apr. 15, 2003**

(54) FACETED MULTI-CHIP PACKAGE TO PROVIDE A BEAM OF UNIFORM WHITE LIGHT FROM MULTIPLE MONOCHROME LEDS

(75) Inventors: Michael Pashley, Cortlandt Manor, NY (US); Thomas Marshall, Hartsdale, NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 113 days.

This patent is subject to a terminal disclaimer.

(21) Appl. No.: 09/746,034

(22) Filed: Dec. 21, 2000

(65) Prior Publication Data

US 2002/0080622 A1 Jun. 27, 2002

(51) Int. Cl.[7] ..... F21V 7/00
(52) U.S. Cl. ..... 362/231; 362/235; 362/296
(58) Field of Search ..... 362/231, 235, 362/296, 230, 293, 555, 583, 240, 800, 247, 346, 304

(56) References Cited

U.S. PATENT DOCUMENTS

| | | | | |
|---|---|---|---|---|
| 4,964,025 A | | 10/1990 | Smith | 362/346 |
| 5,255,171 A | * | 10/1993 | Clark | 355/70 |
| 5,723,868 A | | 3/1998 | Hammond, Jr. et al. | 250/553 |
| 5,810,463 A | | 9/1998 | Kawahara et al. | 362/31 |
| 5,921,652 A | | 7/1999 | Parker et al. | 362/31 |
| 6,191,872 B1 | * | 2/2001 | DeCaro et al. | 358/505 |
| 6,200,002 B1 | * | 3/2001 | Marshall et al. | 362/231 |
| 6,257,737 B1 | * | 7/2001 | Marshall et al. | 362/231 |

FOREIGN PATENT DOCUMENTS

| | | | |
|---|---|---|---|
| EP | 0426397 A1 | 5/1991 | F21V/7/09 |
| EP | 0762515 A2 | 3/1997 | H01L/33/00 |
| FR | 2113474 A | 6/1972 | F21V/7/00 |
| GB | 2224344 A | 5/1990 | F21V/7/00 |
| GB | 2282700 A | 4/1995 | F21V/7/00 |
| JP | 05021842 A | 1/1993 | H01L/33/00 |
| JP | 10004215 A | 1/1998 | H01L/33/00 |
| JP | 11150306 A | 6/1999 | H01L/33/00 |
| WO | 9901695 A1 | 1/1999 | F21Q/1/00 |
| WO | WO0058664 | 10/2000 | F21K/7/00 |

* cited by examiner

*Primary Examiner*—Thomas M. Sember
*Assistant Examiner*—Hargobind S. Sawhney
(74) *Attorney, Agent, or Firm*—Ernestine C. Bartlett

(57) ABSTRACT

A light source includes an array of LED components in each of a plurality of colors such as red, green, and blue in the entrance aperture of a tubular reflector which has an exit aperture, an optic axis extending between the apertures, and a reflective circumferential wall extending between the apertures to reflect and mix light from the array of LED components. At least a portion of the circumferential wall of the reflector body has a polygonal cross-section taken normal to the optic axis, and at least a portion of the cross-section taken parallel to the optic axis includes segments of a curve joined one to the next to form a plurality of facets for reflecting light from the LED components to said exit aperture. Preferably, the segments of the curve included in the cross-section of the reflector body taken parallel to the optic axis are contiguous, linear trapezoidal facets.

24 Claims, 6 Drawing Sheets

DESIGN 1 2 x 20°

| $r_0$ | 4.5 mm |
|---|---|

| i | $\theta_i$ (deg) | $h_i$ (mm) |
|---|---|---|
| 1 | 41.5 | 1.617 |
| 2 | 34.5 | 2.569 |
| 3 | 37.5 | 5.232 |
| 4 | 20.5 | 13.405 |
| 5 | 27.0 | 12.375 |
| 6 | 17.5 | 13.500 |
| 7 | 12.5 | 16.875 |

DESIGN 2 2 x 10°

| $r_0$ | 4.5 mm |
|---|---|

| i | $\theta_i$ (deg) | $h_i$ (mm) |
|---|---|---|
| 1 | 41.5 | 1.617 |
| 2 | 34.5 | 2.569 |
| 3 | 37.5 | 5.232 |
| 4 | 20.5 | 13.405 |
| 5 | 27.0 | 13.500 |
| 6 | 17.5 | 13.500 |
| 7 | 13.0 | 27.000 |
| 8 | 11.0 | 45.000 |
| 9 | 9.0 | 63.000 |
| 10 | 7.0 | 81.000 |

FIG. 3

FACETED MULTI-CHIP PACKAGE TO PROVIDE A BEAM OF UNIFORM WHITE LIGHT FROM MULTIPLE MONOCHROME LEDS

FIELD OF THE INVENTION

This invention relates to a luminaire having a reflector structure which mixes light from a multi-color array of LEDs, and more particularly to such luminaire which mixes light to generate a white light spotlight from such an array.

BACKGROUND OF THE INVENTION

The standard light source for small to moderate size narrow beam lighting for accent lighting and general illumination is the incandescent/halogen bulb, such as a PAR (parabolic aluminized reflector) lamp. These light sources are compact and versatile, but they are not very efficient. A given lamp operates at a given color temperature for a fixed power, and while they are dimmable, the color temperature shifts with the level of applied power according to the blackbody law, which may or may not be the variation that the user desires.

An array of LEDs in each of a plurality of colors offers the possibility of creating a luminaire in which the color temperature may be controlled at any power level, thereby enabling a lamp which is dim able and emits a uniformly white light at any power level.

Our co-pending application Ser. No. 09/277,645, filed Mar. 26, 1999, now U.S. Pat. No. 6,200,002B1 issued Mar. 13, 2001, titled "Luminaire Having A Reflector For Mixing Light From A Multi-Color Array of LEDs", is assigned to the same assignee as the present application, and the disclosure thereof is hereby incorporated in this application by this reference thereto. The application indicates that the problem encountered with a luminaire structure design that uses red, green, and blue LEDs and a reflector structure to make color-controllable white-light spotlights suitable for accent lighting and general illumination is mainly to get good color mixing and still keep the total transmission efficiency high, and the beam narrow and well controlled. Said co-pending application achieves good mixing with improved results when compared to the prior art with a structure wherein a light source which includes an array of LEDs in each of a plurality of colors such as red, green, and blue, is provided in the entrance aperture of a tubular reflector which preferably has convex walls facing the optic axis and flares outward toward the exit aperture, and preferably has a polygonal cross section such as a square. In a preferred embodiment of the invention disclosed and claimed in said co-pending application, the light source utilizes an array of LEDs, including at least one LED in each of a plurality of colors, for emitting light in each of the plurality of colors. The array is arranged in the entrance aperture of a reflecting tube having an opposed exit aperture from which light is emitted after being reflected and mixed by a circumferential wall extending between the apertures.

The light source has an optic axis extending between said apertures centrally of the circumferential wall, and a cross-section transverse to the axis. The cross-section is preferably non-round along at least part of the optic axis and is preferably polygonal along the entire length of the axis. Square and octagonal cross-sections are used for mixing light from the various colors. Most notably, the circumferential wall diverges from the entrance aperture to the exit aperture, and the exit aperture is larger than the entrance aperture. The circumferential wall, seen from the optic axis preferably has a convex shape and flares outward toward the exit aperture. That is the radius of curvature of the wall decreases toward the exit aperture, making the reflector somewhat horn-shaped. We refer to such a structure as a "horn" luminaire because of its generally flared shape. Our horn luminaire has a planar array of LEDs that sit at specified positions within an input aperture, and the emitted light from the various colors is mixed by several reflections from concave-curved walls. In general, in most embodiments of the horn luminaire, some provision must be made to direct the LED light into an initial cone of about 2×60° before the light is incident on the main reflective walls of the horn. The horn luminaire provides the desirable features of a PAR lamp, plus independent color-temperature and dimming control, all at greater luminous efficacy than a PAR lamp. Moreover, the horn luminaire employs a set of red, green and blue LEDs, to make uniform white light in a relatively narrow to moderate beam.

There is still, however, a need in the art for a light source that comprises a luminaire that is effective as the LED package as well as the optical element, and where the reflector body can accept the full 2×90° emission of the array of LED chips without any provision for "primary optics" close to the individual LEDs.

SUMMARY OF THE INVENTION

An object of the present invention is to provide a light source which comprises a tubular reflector which is effective as the LED package as well as the optical element.

Another object of the invention is to provide a light source which comprises a reflector body that can accept the full 2×90° emission of an array of LED components without the necessary provision for "primary optics" close to the individual LEDs.

These and other objects of the invention are accomplished, according to a description of the present invention that follows:

This invention in its preferred embodiments provides a white or color-controlled spotlight for general illumination and accent lighting, using red, green, and blue LEDs, and especially LED chips as sources.

This invention is an alternative to the horn luminaire described and claimed in our said co-pending application Ser. No. 09/277,645 referred to above. As in the invention of said co-pending application, according to the present invention also (a) an LED light source is provided that will provide all of the desirable features of PAR lamps, the ability to vary and control color temperature, at full power and when dimmed, all at greater luminous efficacy; (b) good color mixing is provided for an extended size of array of LEDs; and (c) a collimated beam of mixed light emerging from the light source is provided.

The preferred embodiment of the invention utilizes an array of LED chips which fills the entrance aperture of a reflector having a polygonal cross-section.

For an economically viable product, the requirements of high light output, good control over emission pattern, small size, high efficiency, and good color mixing in both the near field and the far field must be met and are met by the light sources of this invention.

According to the present invention, a white or color-controlled spotlight for general illumination and accent lighting, using red, green, and blue LED chips as sources is provided which meets the requirements stated above for an economically viable product. An improved reflector which is the LED package, i.e. the primary package for the LEDs, as well as the luminaire or optical element, is provided which in a first embodiment, has a polygonal cross-section taken normal to the optic axis, preferably a hexagonal or octagonal cross-section, and wherein at least a portion of the circumferential body, and (i.e., the reflector walls) comprises or is defined by planar trapezoidal segments or facets.

This invention provides a light source comprising:

an array of LED components comprising at least one LED component in each of a plurality of colors for emitting light in each of a plurality of colors and a reflecting tube having an entrance aperture, an exit aperture, a reflective circumferential wall extending between said apertures, and an optic axis extending between said apertures centrally of said wall, said array of LED components being arranged in said entrance aperture, said reflective circumferential wall being arranged to reflect and mix light from said array of LED components, wherein the reflecting tube has a polygonal cross-section taken normal to the optic axis, preferably a hexagonal or octagonal cross-section, and wherein at least a portion of the circumferential body comprises planar trapezoidal segments or facets.

The improved reflector can accept the full 180 degrees of emissions from the LED array, and there is more flexibility in the design of the output beam.

BRIEF DESCRIPTION OF THE DRAWINGS

FIG. 3 illustrates parameters for two different spotlight embodiments of the invention;

DETAILED DESCRIPTION OF THE PREFERRED EMBODIMENTS

In accordance with the invention, in a white light version of a preferred embodiment of the invention, LED chips of the three primary colors red (R), green (G), and blue (B), are arranged in a two-dimensional planar array on a reflective substrate.

The chips are preferably arranged in patterns having the following properties as viewed in the x-y plane; (1) each source color distribution (R, G, and B) has its center of gravity lying on the optic axis, and (2) each source color distribution has the same mean radial distance from the optic axis.

For convenience, we describe only three-color LED chips or injectors. However, it will be understood that there may be two, three, four, or more different-colored LEDs used to achieve the color and color-control properties desired. Although details will vary, the structure can be tailored to mix any number of different source colors.

The luminaire of the invention has a planar array of LED components or chips on a reflective planar surface at the input aperture of the main reflector body and is thus the primary package for the LEDs as well as the luminaire. The specific details of the LED array pattern in terms of its symmetry and the average radial distance of the chips are importantly interrelated to the specific reflector structure design. The invention may be used with any number of different colors, as application needs arise. Optionally, the individual LED chips may have some provision for individual primary optics. However, such is not necessary for a successful operation of the invention. In general, a main objective of the invention is to avoid the need for such primary optics.

Figure 1A:
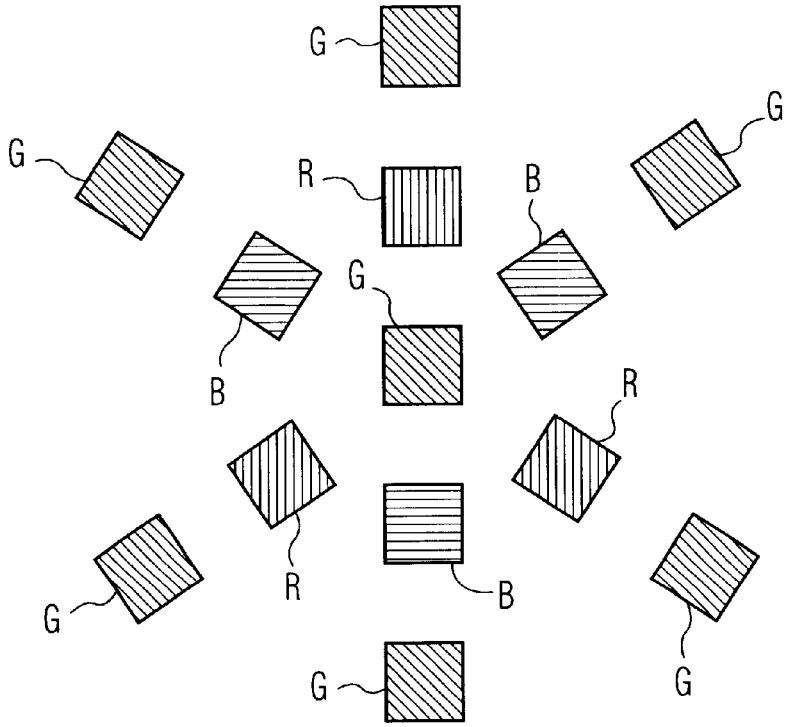
FIG. 1*a* is a schematic view of an array of LEDs in red, green, and blue with six-fold symmetry.
Figure 1B:
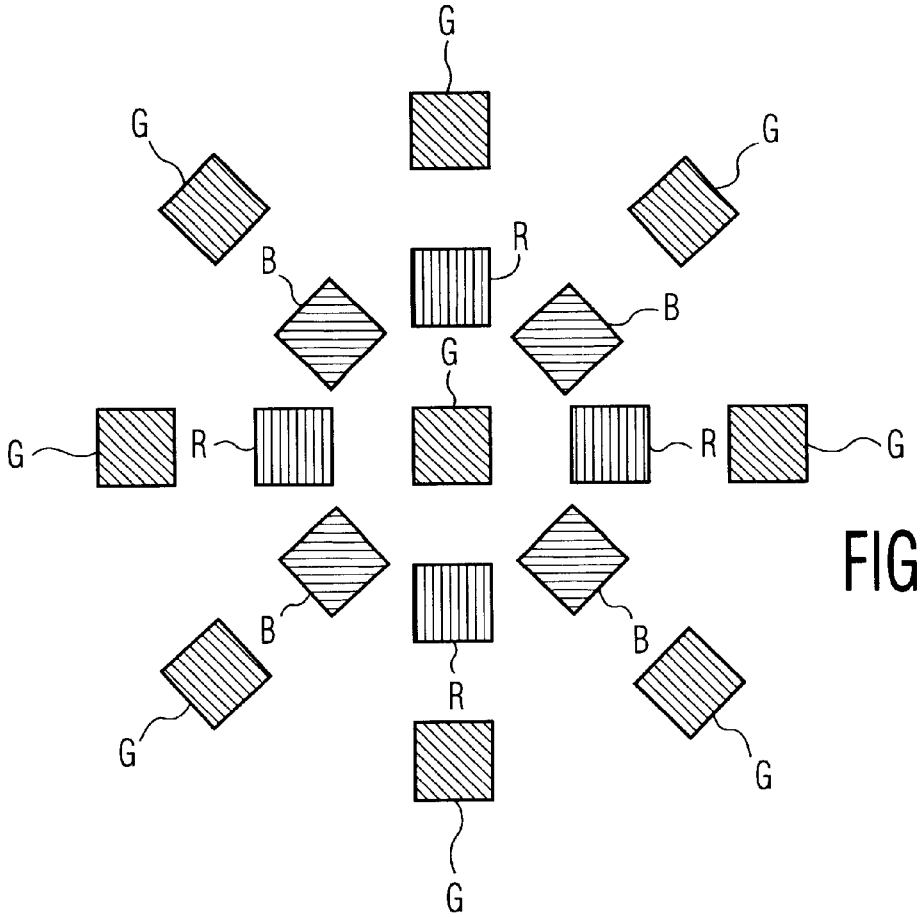
FIG. 1*b* is a schematic view of an array of LEDs in red, green, and blue with eight-fold symmetry.

In order to achieve the desired white light output, it is necessary to have a given ratio of red, green and blue chips that is dependent on the relative light outputs of the red, green and blue chips. This relative performance is likely to change as the LED technology improves. For the preferred embodiment, we have found satisfactory results by arranging a plurality of LEDs in a hexagonal pattern as illustrated in FIG. 1*a*. With reference to FIGS. 1*a* and 1*b*, for purposes of illustration only, in one example, the LED chip number ratios of red (R), green (G), and blue (B) are selected to be about 1 to 2 to 1, i.e. R:G:B=1:2:1. We have found that the best results are achieved when all of the chips have the same mean radial distance from (and with the centroids on) the optic axis. Preferably, all of the chips will have the same symmetry about the optic axis, to the extent possible. Under these conditions, the best results were obtained by selecting the number of blue chips to be equal to the number of red chips with the number of green chips being one more than twice the number of red chips. In several of the embodiments studied, the chip number ratios R:G:B were (a) 3:7:3 and (b) 4:9:4, respectively. With reference to FIGS. 1*a* and 1*b*, the (a) chipset was arranged with six-fold symmetry and the (b) chipset with eight-fold symmetry. In each case, there is an outer ring of green chips, and an inner ring of alternating red and blue chips. A central green chip serves to put the average radial distance of the green chips closer to that of the red and blue chips. If the manufacture permits the use of different sizes of green chips, then the average radial distance of all chips can be made the same by using a larger green chip in the center. This is preferable but not essential for satisfactory performance.

Figure 2:
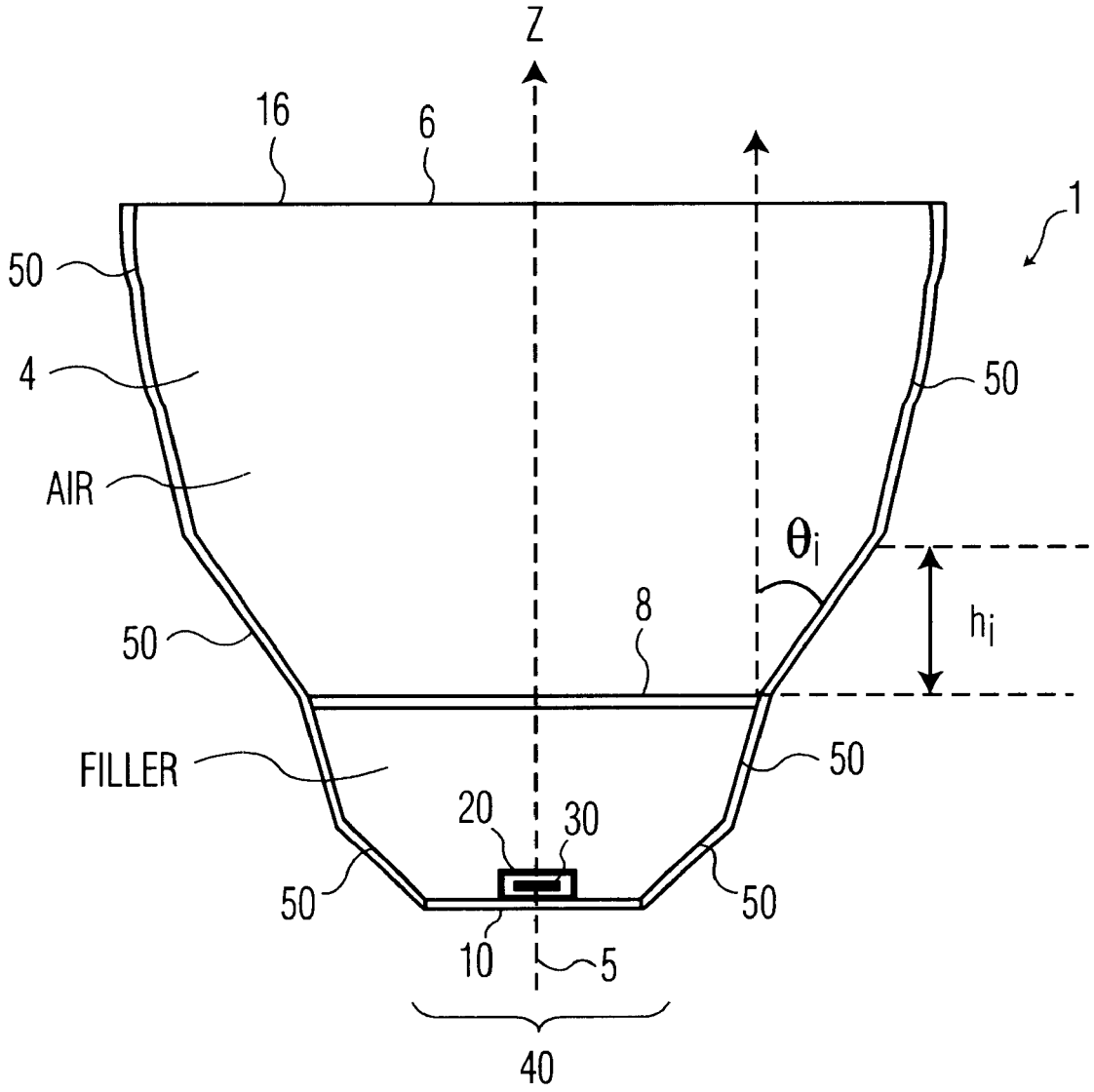
FIG. 2 is a schematic cross-section taken parallel to the optic axis of a reflector of this invention.

With reference to the drawings, FIG. 2 is a schematic cross-section taken parallel to the optic axis of a reflector of this invention. As illustrated, a reflector 1 is provided with at least a portion of its circumferential wall having a polygonal cross-section and at least a portion of the circumferential body comprising facets 50. The reflector collimates light to the desired angular distribution and mixes the light from each LED package 40 which includes a plurality of red, green, and blue LED chips 10, 20 and 30. A first section 2 of the reflector comprises filler 3/encapsulant 3' material for the LED chips and forms a multi-chip LED package 40. A top section 4 may be in air, if desired and is in fact preferred to be in air due to favorable cost and weight considerations. FIGS. 2, 3, 4*a* and 4*b* illustrate parameters $r_0$, i, $h_i$, and $\theta_i$ for two different spotlight embodiments of the invention. These parameters are discussed further hereinbelow.

The reflector 1 is a hollow tube-like structure with n-fold symmetry (typically n=6 or 8, but may be any integer) about the optic axis (the z-axis). Best results are obtained when the reflecting tube 1 and the chipset 10, 20, 30, which constitute the LED array 40, have the same symmetry. The reflector has a height h along the optic axis. An input aperture 5 is taken to lie in the plane z=0, and the exit aperture 6 to lie in the plane z=−h. The cross-section in any plane perpendicular to the z-axis is a regular polygon, for example, a hexagon or an octagon, centered about the z-axis. For convenience, we take one edge of the polygon to be parallel to the y-axis. The x-z plane bisects this edge, and we define the "radius at height z", r(z), to be the x-coordinate of the midpoint of the edge. This radius is also the radius of the circle inscribed in the polygon. With the above definitions, a specific reflector shape is defined by the polygon number n and the function r(z), with z having values between 0 and −h. In the primary and preferred form of the reflector, r(z) is a piecewise linear curve, i.e. a curve made up of linear segments. In that case, the reflector body is composed of contiguous (planar) trapezoidal facets, indicated by the reference numeral 50 in FIGS. 2, 4*a*, and 4*b*.

Figure 4A:
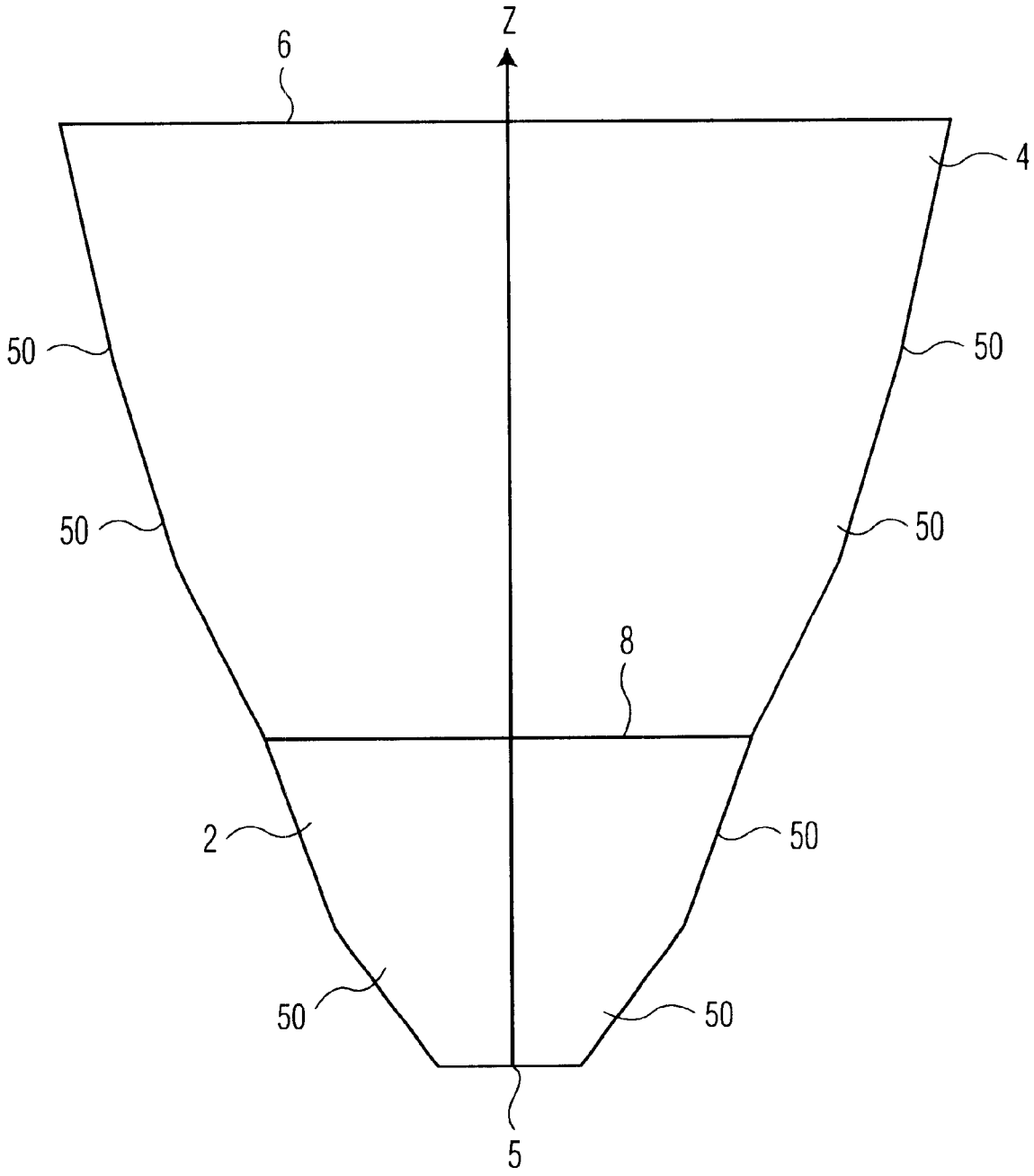
FIG. 4*a* is a cross-section of a reflector exhibiting the parameters illustrated for Embodiment 1 in FIG. 3.
Figure 4B:
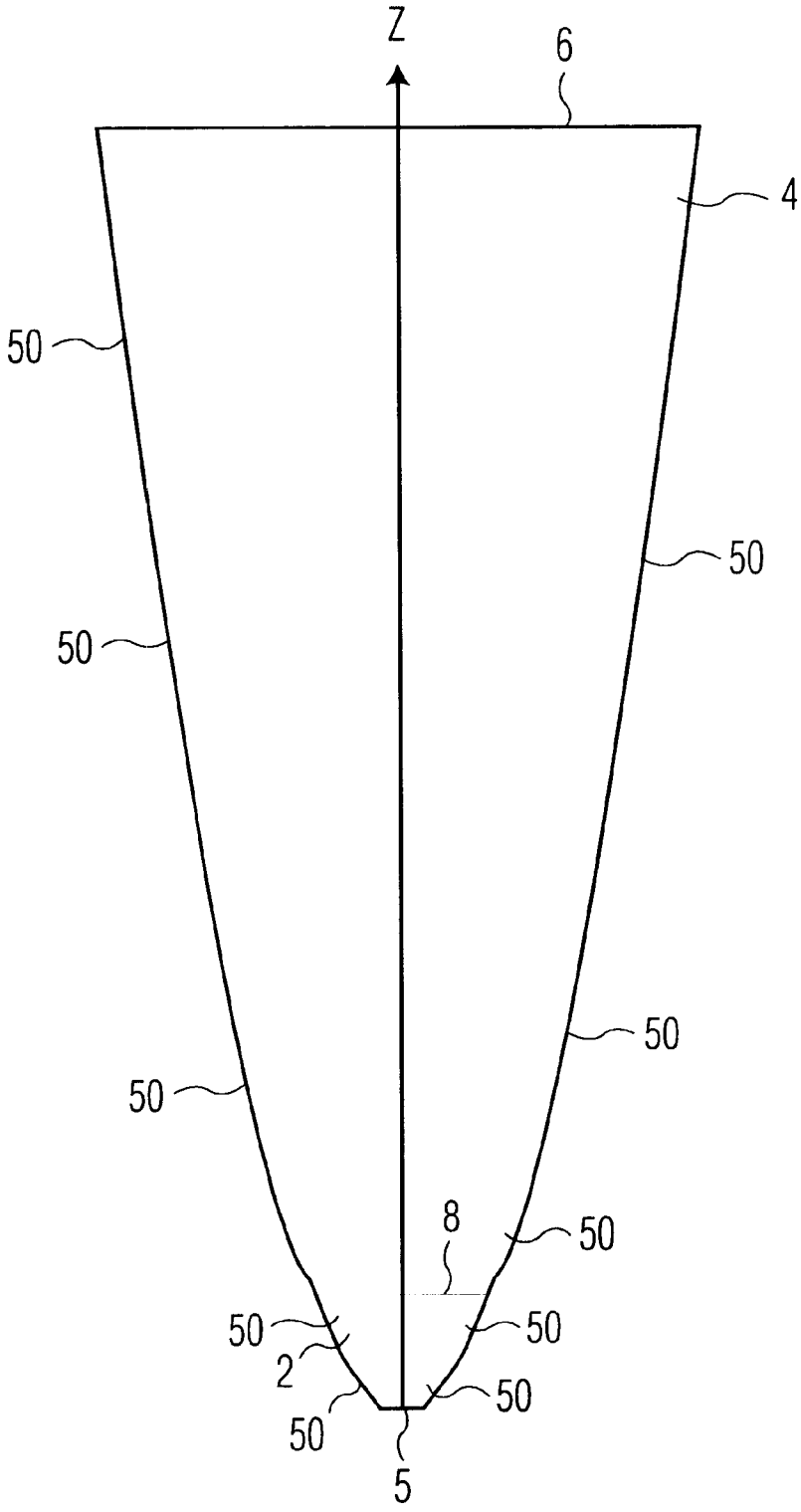
FIG. 4*b* is a cross-section of a reflector exhibiting the parameters illustrated for Embodiment 2 in FIG. 3.
Figure 5A:
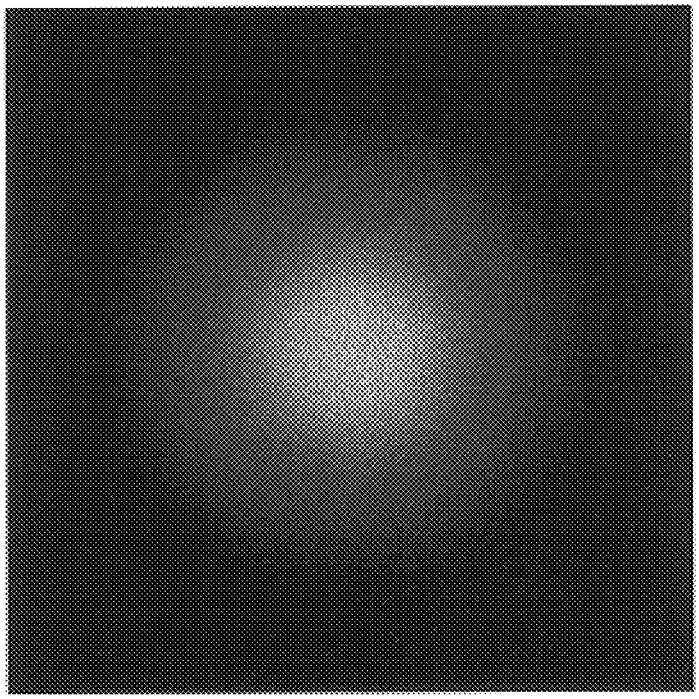
FIGS. 5*a* and 5*b* illustrate pseudo-color images of the far-field patterns for the respective examples of FIG. 3.
Figure 5B:
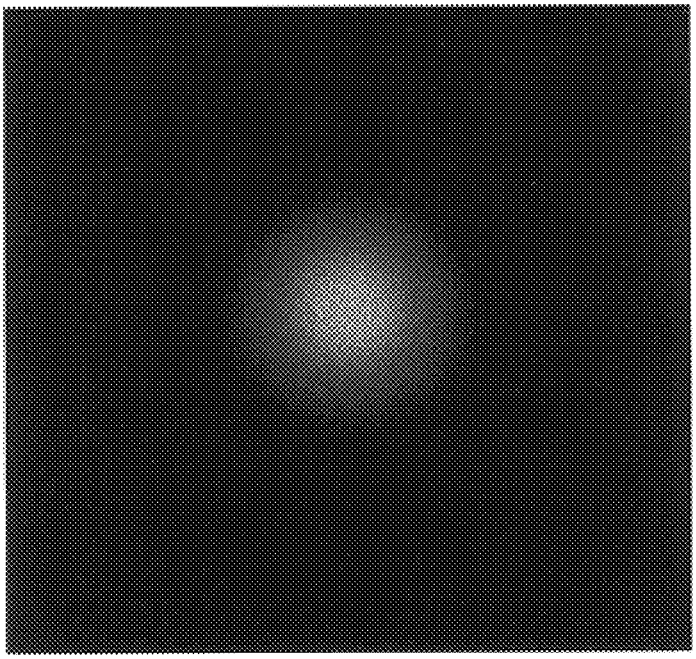

Specific parameters that may be selected in especially preferred embodiments of the invention include the following:

In the case where r(z) is piece-wise linear, the function may be specified by (m+1) points $(z_i, r_i)$ where $i \in \{0, 1, \ldots, m\}$. We introduce the concept of the "$i^{th}$ segment", which is the portion of the reflector body bounded by the planes $z=z_{i-1}$ and $z=z_i$. The segment thus has the height $h_i=(z_{i+1}-z_i)$, and is composed of n trapezoids joined one to the next along their non-parallel sides to form a polygonal tube. Each trapezoid is inclined with respect to the optic axis by an angle $\theta_i=\tan^{-1}(r_{i+1}-r_i)/(z_{i+1}-z_i)$. Thus the surface of the reflector may be uniquely specified by specifying the entrance aperture radius $r_0$ and the 2 m quantities $(h_i, \theta_i)$. FIG. 2 shows a schematic cross-section of a reflector, with the above parameters labeled and the facets joined one to the other to form the reflector tube. FIG. 3 illustrates the $r_0$ and $(h_i, \theta_i)$ values for two specific examples of a reflector of the invention that generate 2×20° and 2×10° beams (at the 80% of total flux level) respectively. FIGS. 4*a* and 4*b* show the cross-sections of the two designs illustrated in FIG. 3, (the figures are not drawn to the same scale), and FIGS. 5*a* and 5*b* show the pseudo-color images of the far field patterns of the reflectors from the designs 1 and 2 of FIGS. 3, 4*a* and 4*b*. Each of the specific spotlight designs may be of any cross-section, for example hexagonal, octagonal, etc., and each may be used with either chipset from FIG. 1, with the appropriate cross section.

The reflector is a hollow tube-like structure that may be filled to a certain extent with a transparent dielectric filler material 3 to enhance the light extraction from the LED array components, which dielectric material may or may not be the same as the encapsulant material 3' for the LED array. Preferably, such materials are composed of the same material and fill the lower section 2 or segment of the reflector, to a height sufficient to minimize total internal reflection at that interface. In some preferred embodiments, a height approximately equal to the radius of the entrance aperture will be satisfactory. In other preferred embodiments, filler material will fill the lower section to a height that is about twice the diameter of the entrance aperture 5. Optionally, a cover plate 16 is provided at the exit aperture 6 for mechanical protection and/or optical diffusion and/or beam steering functions. The reflector structure also includes a surface 8 defining the interface between the dielectric/encapsulant 3,3' and the air within the body of the reflector. This interface 8 is an optical interface having certain parameters as discussed further hereinbelow.

The luminaire of the present invention can accept the full 2×90° emission of the array of LED chips without any provision for "primary optics" close to the individual LEDs, the utilization of primary optics being optional in the present case but not mandatory. The second improvement is that the output beam angle can be more conveniently designed over a larger range of angles. Specifically, in one embodiment of the invention, we have produced an output beam of 2×10° at the 80% point. Conversely, broader beams are easier to produce because it is more straightforward to mix the initially-high-angle light in the present invention.

As discussed above, the reflectors of the invention may include a cover plate 16, preferably a transparent cover plate. Such a plate when used w ll provide mechanical protection to the main reflector, and also defines the exit aperture 6. The plate may be formed of materials such as plastic and glass, for example and may be a flat, smooth plate of clear transparency, or it may have any desired amount of diffusion and may be ground glass, prismatic glass, corrugated glass, etc., and/or it may have steering or refraction properties or combinations of these properties. The specific properties of the cover plate will affect the appearance of the luminaire and to a certain extent will affect the overall light output distribution. The cover plate is, however, not essential to the principle of operation, but rather provides flexibility and variation of the design of the reflector.

Also as discussed above, for several optical and manufacturing reasons well known in the art, the LED chips are normally encapsulated in a dielectric material 3. Such a material will optimally have as high a refractive index as possible up to the refractive index of the LED chip. Typically, such a material will have a refractive index of about 1.5 to 2 or greater. Specific produce properties may be achieved in the choice of the dielectric-air interface, i.e., the surface 8 (see FIG. 2) where the encapsulant dielectric terminates, more specifically, the optical interface. It is also contemplated that, for example, one dielectric material may be used for the physical encapsulation of the chips, while a second material, index-matched to the encapsulant, may also be present in which case there would be a physical interface but not necessarily an optical interface occurring. It is the dielectric-air interface that affects the properties of the reflectors of the invention and that is of importance to the inventive designs. In the preferred facet designs used according to this invention, the dielectric-air interface will occur in a plane separating two segments. Due to the refraction at this interface, the angle θ for the segment on the air side will be in general significantly larger than the preceding angle, even though there is typically a trend that the angles for successive segments decrease. This adjustment in the angle of the segments compensates for the refraction; it is exactly he right degree to continue the converging or collimating trend of the reflector's structural design as a whole.

In the preferred embodiments of the invention, most if not all of the light rays incident on the dielectric-air interface are sufficiently close to normal incidence to avoid total internal reflection. In preferred embodiments, this is achieved by a structure in which the height of the dielectric-air interface is about twice the diameter of the input aperture 5. Preferably also, the dielectric-air interface 8 will have a surface roughness associated with a weak diffusive effect for optimal mixing.

The invention may be embodied in other specific forms without departing from the spirit and scope or essential characteristics thereof, the present disclosed examples being only preferred embodiments thereof.

We claim:

1. A light source comprising an array of light emitting diode components (LEDs) comprising at least one LED in each of a plurality of colors or emitting light in each of a plurality of colors and a reflector tube having an entrance aperture, an exit aperture, a reflector body portion having a reflective circumferential wall extending between said apertures, and an optic axis extending between said apertures centrally of said wall, said array of LED components being arranged in said entrance aperture, and said circumferential wall of the reflector body portion being arranged to reflect and mix light from said array of LED components, wherein at least a portion of the circumferential wall of the reflector body has a polygonal cross-section taken normal to the optic axis, and at least a portion of the cross-section taken parallel to the optic axis includes segments of a curve joined one to the next to form a plurality of facets for reflecting light from said LED components to said exit aperture.

2. A light source as claimed in claim 1, wherein said portion of the circumferential body of the reflector body includes contiguous, linear trapezoidal facets.

3. A light source as claimed in claim 1, wherein said cross-section of the reflector body taken normal to the optical axis is a hexagonal or octagonal cross-section.

4. A light source as claimed in claim 1, wherein said circumferential wall diverges from said entrance aperture to said exit aperture.

5. A light source as claimed in claim 1, wherein the LED components in each color define a color distribution having a center of gravity lying on the optic axis.

6. A light source as claimed in claim 5, wherein each color distribution has the same mean radial distance from the optic axis.

7. A light source as claimed in claim 1 further comprising a diffusive cover on the exit aperture.

8. A light source as claimed in claim 1, wherein said reflective circumferential wall is made of a specular-plus-diffuse reflecting material.

9. A light source comprising an array of light emitting diode chips (LED chips) provided in an entrance aperture of a tubular reflector which comprises an exit aperture, a reflector body portion having a reflective circumferential wall extending between said apertures centrally of the circumferential wall, and an optic axis extending between said apertures centrally of said wall, said circumferential wall being arranged to reflect and mix light from said array of LED chips, wherein at least a portion of the circumferential wall of the reflector body portion has a polygonal cross-section taken normal to the optic axis, and at least a portion of the cross-section taken parallel to the optic axis includes segments of a polygonal curve joined one to the next to form a plurality of contiguous, planar facets for reflecting light from said LED chips to said exit aperture.

10. A light source as claimed in claim 9, wherein said entrance aperture is opposite said exit aperture from which light is emitted after being reflected and mixed by said circumferential wall including said facets extending between the apertures.

11. A light source as claimed in claim 10, wherein the exit aperture is larger than the entrance aperture.

12. A light source as claimed in claim 10, wherein mixing of light is promoted by utilizing a plurality of small LED chips with the distribution of LED chips of each color being centered on the optic axis.

13. A light source as claimed in claim 9, wherein said cross-section is a hexagonal or octagonal cross-section.

14. A light source as claimed in claim 10, wherein said cross-section is polygonal, said circumferential wall comprising a plurality of sidewalls which are faceted in said cross section taken parallel to the optic axis.

15. A light source as claimed in claim 14, wherein said cross section is hexagonal.

16. A light source as claimed in claim 14, wherein said cross-section is octagonal.

17. A light source as claimed in claim 10, wherein said circumferential wall diverges from said entrance aperture to said exit aperture.

18. A light source as claimed in claim 9 further comprising a diffusive cover on the exit aperture.

19. A light source comprising an array of light emitting diode chips (LED chips) provided in an entrance aperture of a tubular reflector which comprises an exit aperture, a reflector body portion having a reflective circumferential wall extending between said apertures centrally of the circumferential wall, and an optic axis extending between said apertures centrally of said wall, said circumferential wall being arranged to reflect and mix light from said array of LED chips, wherein at least a portion of the circumferential wall of the reflector body portion has a polygonal cross-section taken normal to the optic axis, and at least a portion of the cross-section taken parallel to the optic axis includes segments of a polygonal curve joined one to the next to form a plurality of contiguous, planar facets for reflecting light from said LED chips to said exit aperture, and wherein said reflector is a hollow tube-like structure filled at least partially with a transparent dielectric material.

20. A light source as claimed in claim 19, wherein said dielectric material fills a lower portion of said reflector to a height of about twice the diameter of the entrance aperture.

21. A light source as claimed in claim 20, wherein a cover plate is provided at the exit aperture.

22. A light source as claimed in claim 19, wherein the reflector includes a surface that defines an interface between the dielectric material and the air within the body portion of the reflector.

23. A light source as claimed in claim 22, wherein the dielectric material-air interface occurs in a plane separating two contiguous, segments.

24. A light source as claimed in claim 23, wherein the dielectric material-air interface is situated at a height in said reflector body portion that is about twice the diameter of the entrance aperture.

* * * * *